US011077349B2

(12) United States Patent
Smith

(10) Patent No.: US 11,077,349 B2
(45) Date of Patent: Aug. 3, 2021

(54) BALL TEE WITH MOTORIZED RETRIEVAL

(71) Applicant: Noah Smith, Bigelow, AR (US)

(72) Inventor: Noah Smith, Bigelow, AR (US)

( * ) Notice: Subject to any disclaimer, the term of this patent is extended or adjusted under 35 U.S.C. 154(b) by 31 days.

(21) Appl. No.: 16/730,598

(22) Filed: Dec. 30, 2019

(65) Prior Publication Data

US 2021/0197056 A1 Jul. 1, 2021

(51) Int. Cl.
*A63B 69/00* (2006.01)
*A63B 71/00* (2006.01)

(52) U.S. Cl.
CPC ..... *A63B 69/0079* (2013.01); *A63B 69/0075* (2013.01); *A63B 69/0002* (2013.01); *A63B 2069/0008* (2013.01); *A63B 2225/093* (2013.01)

(58) Field of Classification Search
CPC ..... A63B 69/0079; A63B 69/0075; A63B 69/0002; A63B 2069/0008; A63B 2225/0913
USPC ..... 473/417–420, 422, 451
See application file for complete search history.

(56) References Cited

U.S. PATENT DOCUMENTS 3,168,312 A 2/1965 Davis
3,183,000 A * 5/1965 Dix ..... A63B 69/0075 473/417
4,129,110 A * 12/1978 Kubrak ..... A63B 57/405 473/423
4,278,257 A * 7/1981 Garcia ..... A63B 69/0079 473/423
4,993,708 A * 2/1991 Prossor ..... A63B 69/0075 473/417
5,035,424 A * 7/1991 Liao ..... A63B 69/0091 473/423
5,386,988 A * 2/1995 Sung ..... A63B 69/0079 473/423
5,415,396 A 5/1995 Huang
5,494,278 A * 2/1996 Linden ..... A63B 69/0091 473/427
5,540,430 A 7/1996 Nichols
5,580,047 A * 12/1996 Shih ..... A63B 69/0075 473/417
5,797,810 A * 8/1998 Sandoval ..... A63B 69/0091 473/423
5,800,288 A * 9/1998 Mims ..... A63B 69/40 473/417
5,957,788 A * 9/1999 Eze ..... A63B 69/0091 473/422
6,398,671 B1 * 6/2002 Rios ..... A63B 69/0075 473/417

(Continued)

*Primary Examiner* — Mitra Aryanpour

(57) ABSTRACT

A ball tee with motorized retrieval for re-seating a ball after hitting includes a base having a top surface. A housing is attached to and extends upwardly from the base. The housing has a top wall and an interior surface. The top wall has an aperture extending therethrough to the interior surface. A tether container is positioned within the housing. A tee is attached to and extends upwardly from the top wall. A ball is attached to the tether container by a tether. A driver mechanism is mounted on the interior surface. The driver mechanism is coupled to a drive roller such that the drive roller is rotatable by the driver mechanism. An actuating mechanism actuates a wheel toward the drive roller to engage with the tether and the drive roller. The drive roller rotates to retract the tether into the tether container and reseat the ball.

18 Claims, 6 Drawing Sheets

(56) References Cited

U.S. PATENT DOCUMENTS

| | | | | |
|---|---|---|---|---|
| 6,551,204 | B1 * | 4/2003 | Di Re | A63B 69/0002 473/417 |
| 6,719,649 | B1 * | 4/2004 | Lin | A63B 69/0002 473/417 |
| 7,048,653 | B2 * | 5/2006 | Heimers | A63B 69/385 473/424 |
| 7,169,067 | B2 * | 1/2007 | Town | A63B 69/0002 473/417 |
| 7,273,428 | B2 * | 9/2007 | James | A63B 69/0002 473/142 |
| 7,887,441 | B1 * | 2/2011 | Archer | A63B 69/0053 473/417 |
| 8,029,389 | B2 * | 10/2011 | Chiu | A63B 69/0073 473/417 |
| 8,033,934 | B1 * | 10/2011 | Clancy | A63B 69/0002 473/430 |
| 8,246,493 | B1 * | 8/2012 | Ling | A63B 21/169 473/417 |
| 8,870,687 | B2 * | 10/2014 | Lay | A63B 69/0002 473/417 |
| 8,900,075 | B2 * | 12/2014 | Gu | A63B 69/0079 473/423 |
| 8,979,681 | B1 | 3/2015 | Murphy | |
| D880,629 | S * | 4/2020 | Wills | A63B 69/0079 D21/717 |
| 2007/0072703 | A1 | 3/2007 | James | |
| 2012/0190482 | A1 | 7/2012 | Cotttreau | |

* cited by examiner

BALL TEE WITH MOTORIZED RETRIEVAL

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to ball tee devices and more particularly pertains to a new ball tee device for re-seating a ball after hitting. The disclosure covers a ball tee that retrieves the ball and re-seats the ball on the tee by use of a tether and motor.

(2) Description of Related Art Including Information Disclosed Under 37 CFR 1.97 and 1.98

The prior art relates to ball tee devices. The prior disclosures use various methods of resetting a hittable object for hitting.

BRIEF SUMMARY OF THE INVENTION

An embodiment of the disclosure meets the needs presented above by generally comprising a base including a top surface. A housing is attached to and extends upwardly from the base. The housing has a top wall and a perimeter wall extending between the top wall and the base. The top wall has a top side and a bottom side. The perimeter wall has a top edge, a bottom edge, an interior surface and an exterior surface. The top wall has an aperture extending therethrough from the top side to the bottom side. A tether container is positioned within the housing. A tee is attached to and extends upwardly from the top wall. A ball is attached to the tether container by a tether. A driver mechanism is mounted on the interior surface. The driver mechanism is coupled to a drive roller such that the drive roller is rotatable in a first direction by the driver mechanism. An actuating mechanism is attached to the interior surface. The actuating mechanism is coupled to a wheel such that the wheel is actuatable between a stored position wherein the wheel is disengaged from both of the tether and the drive roller and rests nearer the interior surface, and a retrieval position wherein the wheel is moved toward the drive roller to engage with the tether and the drive roller such that the drive roller pulls the tether into the tether container from the tee when the drive roller rotates in the first direction.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
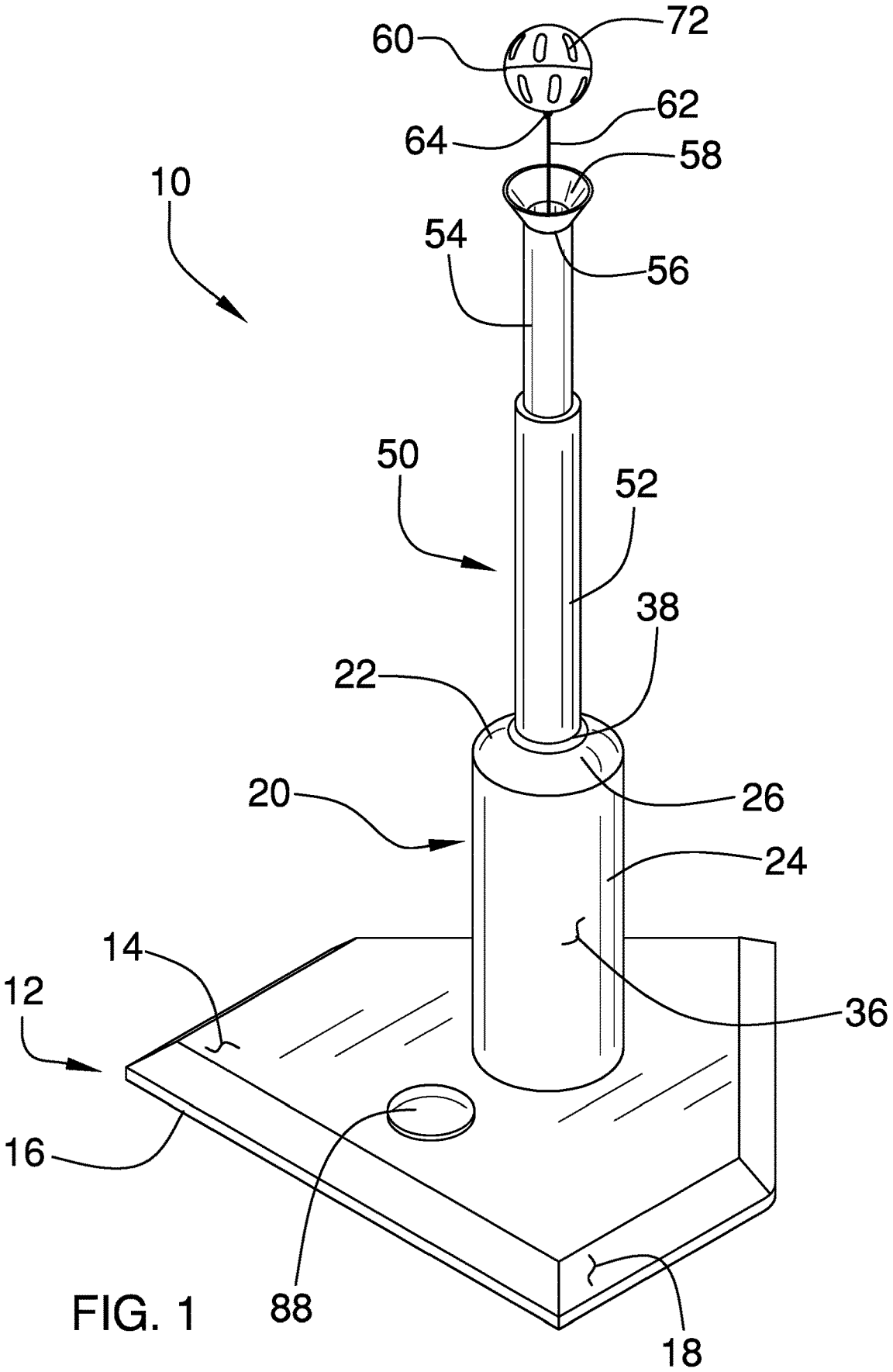
FIG. 1 is an isometric view of a ball tee with motorized retrieval according to an embodiment of the disclosure.
Figure 2:
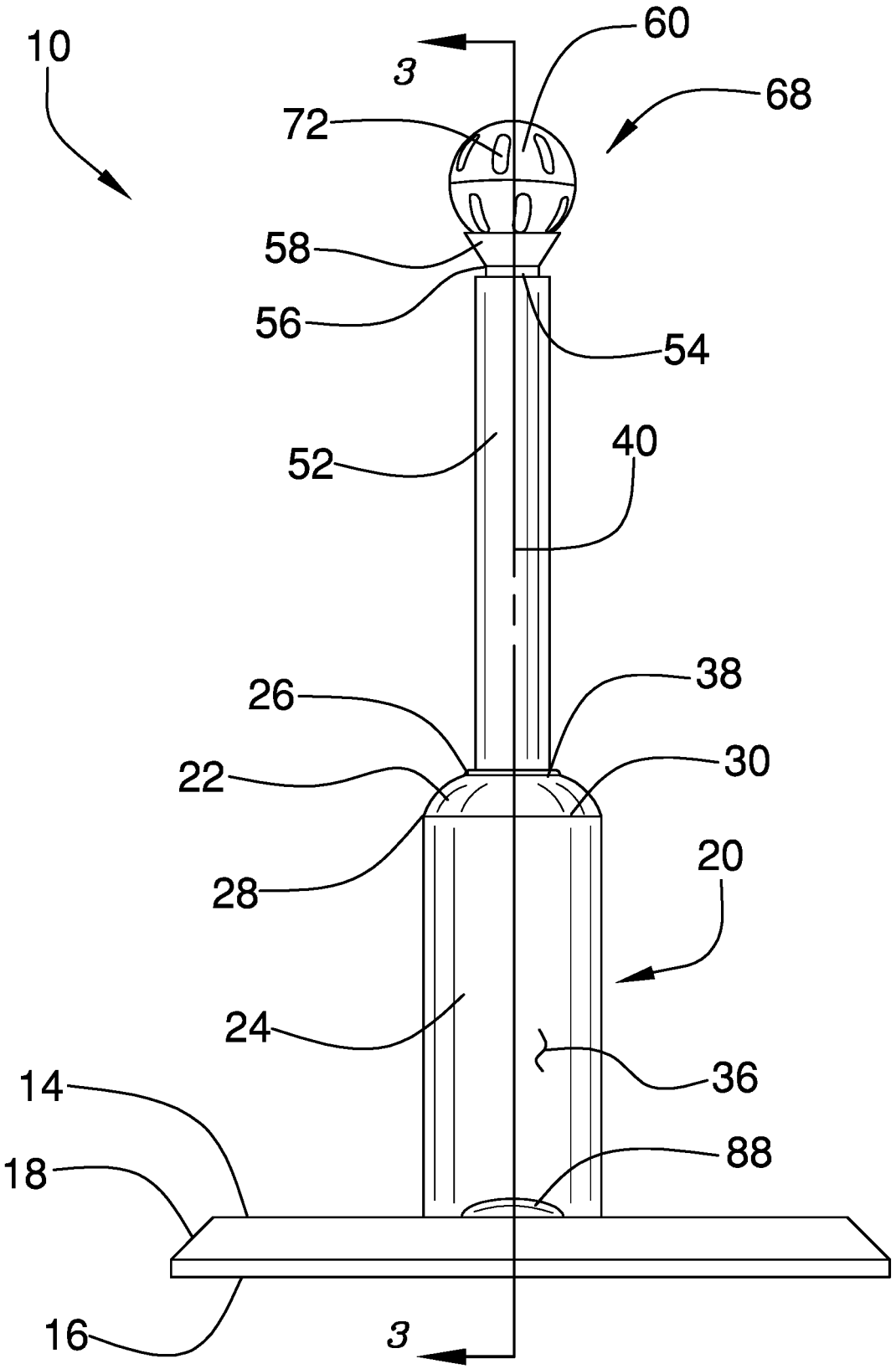
FIG. 2 is a front view of an embodiment of the disclosure.
Figure 3:
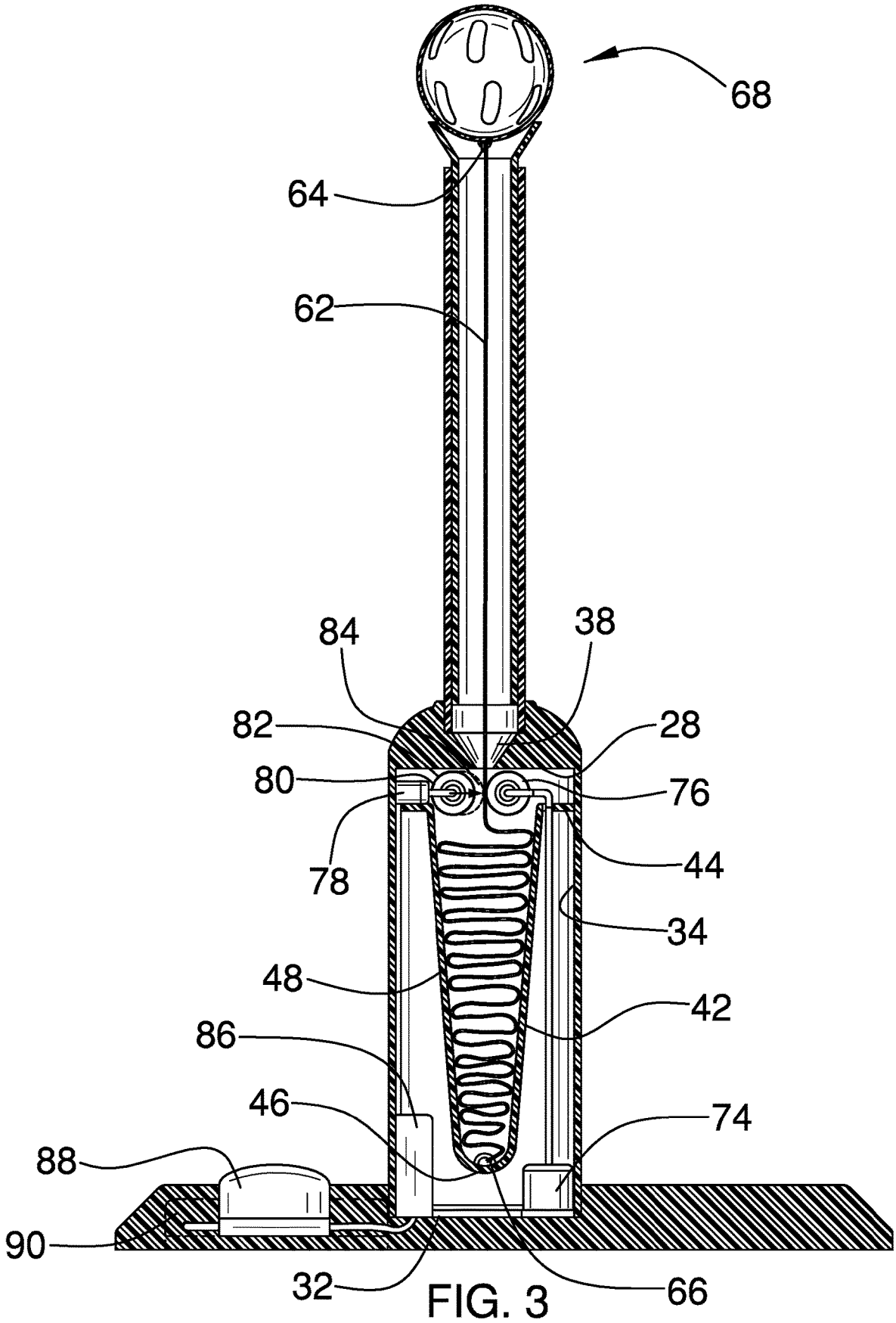
FIG. 3 is a cross-sectional view of an embodiment of the disclosure taken along line 3-3 in FIG. 2.
Figure 4:
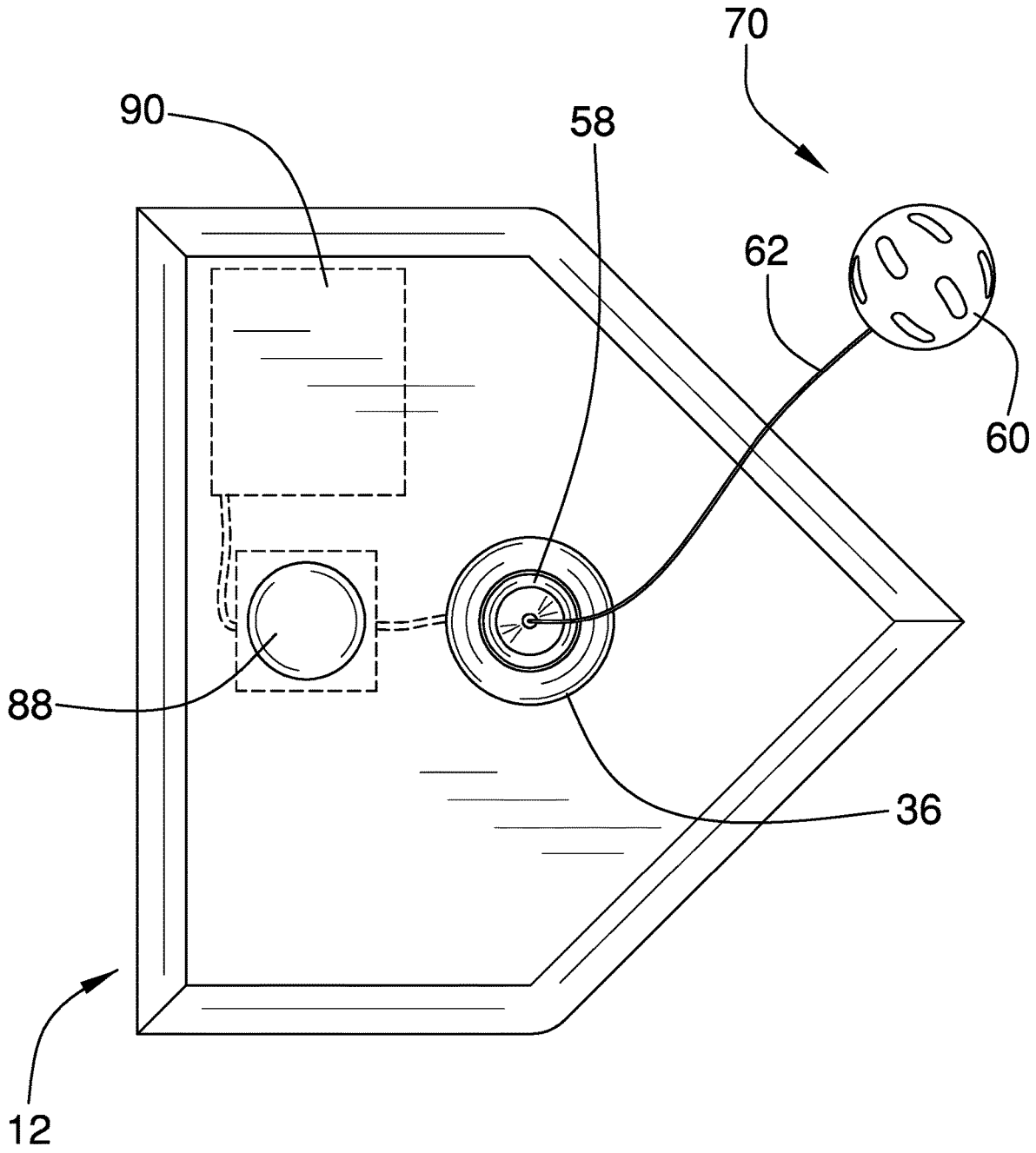
FIG. 4 is a top view of an embodiment of the disclosure.
Figure 5:
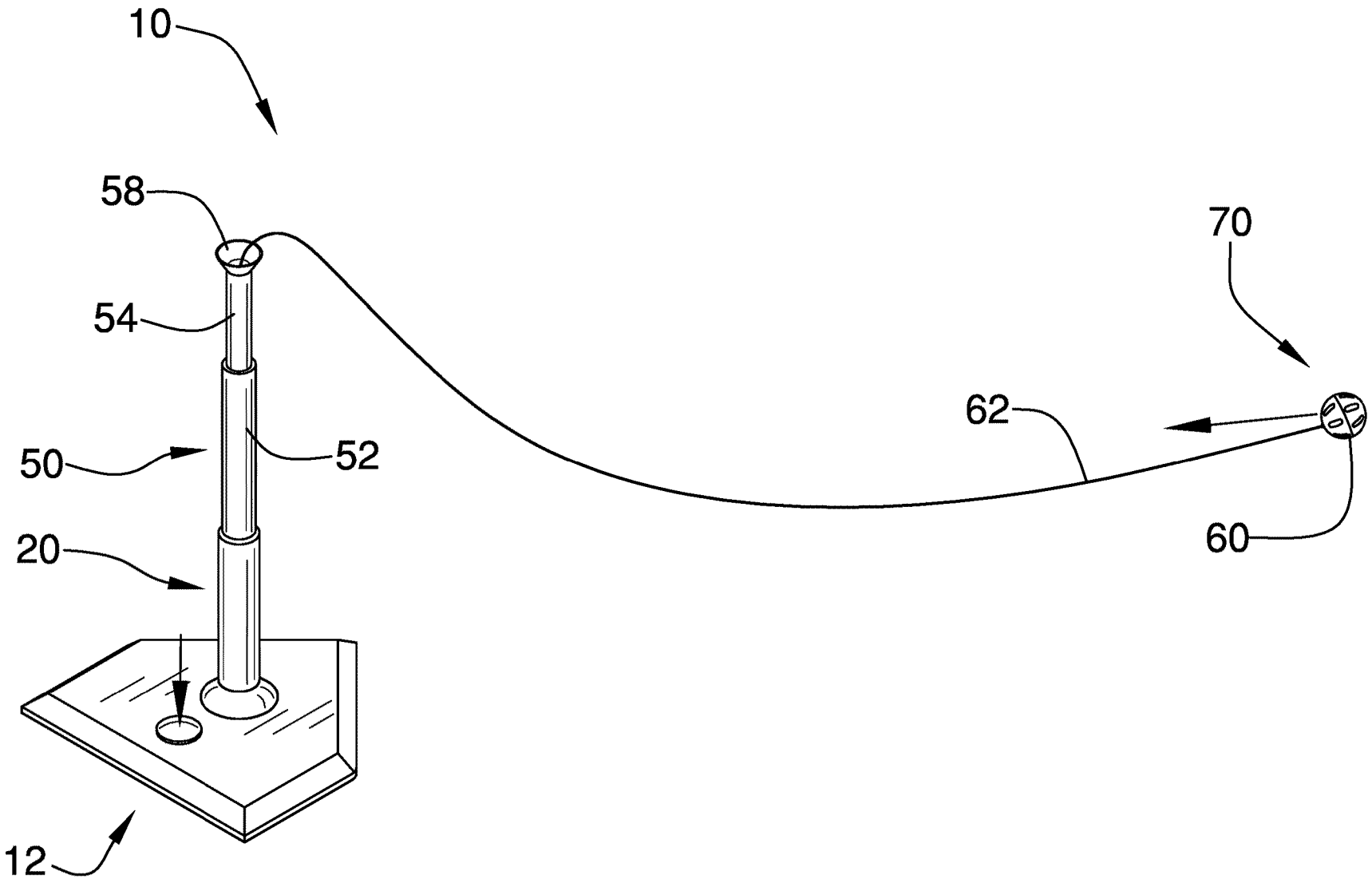
FIG. 5 is an in-use view of an embodiment of the disclosure illustrating how to return the ball to the tee.
Figure 6:
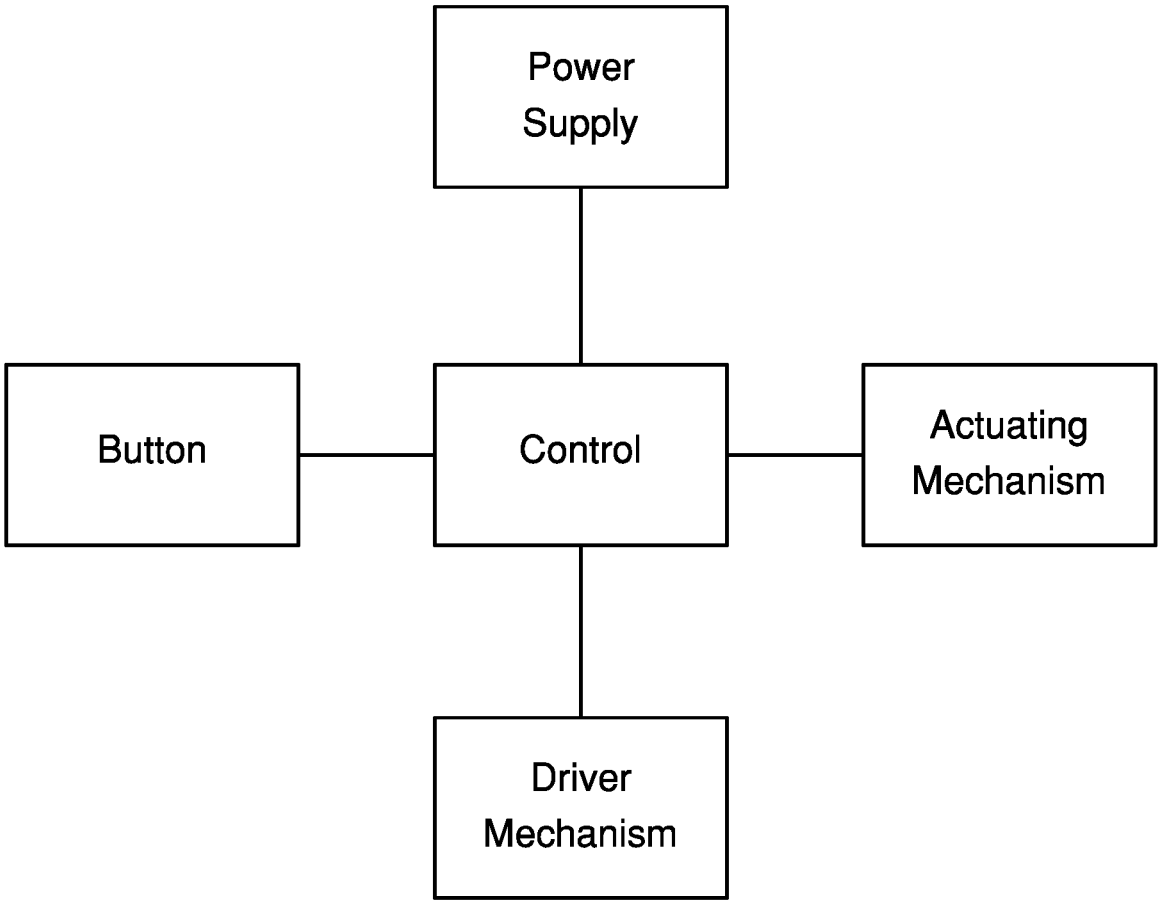
FIG. 6 is a diagram view of the control in an embodiment of the disclosure.

With reference now to the drawings, and in particular to FIGS. 1 through 6 thereof, a new ball tee device embodying the principles and concepts of an embodiment of the disclosure and generally designated by the reference numeral 10 will be described.

As best illustrated in FIGS. 1 through 6, the ball tee with motorized retrieval 10 generally comprises a base 12. The base 12 includes a top surface 14, a bottom surface 16 and a perimeter edge 18 extending between the top surface 14 and the bottom surface 16. The top surface 14 and the bottom surface 16 are positioned a distance between 0.50 inch and 1.50 inches apart. The base 12 may have a profile to match a baseball home plate. The base 12 is made of a rigid material.

A housing 20 is attached to and extends upwardly from the base 12. The housing 20 has a top wall 22 and a perimeter wall 24 extending between the top wall 22 and the base 12. The top wall 22 has a top side 26 and a bottom side 28. The perimeter wall 24 has a top edge 30, a bottom edge 32, an interior surface 34 and an exterior surface 36. The top wall 22 has an aperture 38 extending therethrough from the top side 26 to the bottom side 28. The aperture 38 is centrally positioned along a central axis 40 of the top wall 22 and the housing 20. The aperture 38 increases in diameter between the bottom side 28 and half the distance between the bottom side 28 and the top side 26.

A tether container 42 is positioned within the housing 20. The tether container 42 has a top lip 44, an end wall 46 and a side wall 48 extending downwardly toward the base 12 between the top lip 44 and the end wall 46. The top lip 44 extends outwardly from the side wall 48 to attach to the interior surface 34 of the housing 20. The top lip 44 is positioned offset from the top edge 30 at a distance between 1.00 inch and 4.00 inches apart. The side wall 48 has a larger diameter near the top lip 44 compared to a smaller diameter near the end wall 46.

A tee 50 is attached to and extends upwardly from the top wall 22. The tee 50 includes a first section 52. The first section 52 is attached to and extends upwardly from the aperture 38 of the top wall 22. A second section 54 is telescopically coupled to and extends away from the first section 52. The second section 54 has free end 56 positioned opposite the housing 20. A cup 58 is attached to and extends upwardly from the free end 56. The cup 58 has an increasing diameter opposite the free end 56. The first section 52, the second section 54, and the cup 58 all are tubular such that the tether container 42 is accessible along the central axis 40 of the top wall 22 and the housing 20. A locking member releasably engages each of the first section 52 and the second section 54 to selectively secure the first section 52 and the second section 54 at a selectable position relative to each other. The tee 50 is adjustable to a plurality of heights between 2.00 feet and 5.00 feet from the base 12. The locking member may use any one of a variety of mechanical locking methods including a friction lock, a biased detent and aperture method, or any other conventionally available mechanical methods.

A ball 60 is attached to the tether container 42 by a tether 62. The tether 62 has a first end 64 attached to the ball 60, and a second end 66 attached to the end wall 46 of the tether container 42. The tether 62 has a length to allow the ball 60 to travel between a first position 68 wherein the ball 60 is engaged with the cup 58 and the tether 62 is within the tee 50 and the tether container 42, and a second position 70 wherein the ball 60 is traveling away from the tee 50 and the tether 62 is traveling out of the tether container 42 and outside of the tee 50 until the second end 66 engages with the tether container 42 to stop the ball's 60 travel. The tether 62 is comprised of flexible material capable of being coiled within the tether container 42. Suitable tether 62 materials include a rope of synthetic or natural fibers, a tape, a chain, or any other conventionally available flexible material capable of coiling into the tether container 42. The ball 60 may have an outer shell bounding a hollow core. The ball may have voids 72 extending therethrough the outer shell to access the hollow core.

A driver mechanism 74 is mounted on the interior surface 34. The driver mechanism 74 is coupled to a drive roller 76 such that the drive roller 76 is rotatable in a first direction by the driver mechanism 74. The drive roller 76 is aligned with the tether 62 when the tether 62 passes between the tether container 42 and the aperture 38 of the top wall 22. The driver mechanism 74 sends a seated input when the driver mechanism 74 senses a sharp increase in torque is required to rotate the drive roller 76 due to the tether 62 being unable to move further into the tether container 42. The driver mechanism 74 uses an electric motor to rotate a shaft which rotates the drive roller 76.

An actuating mechanism 78 is attached to the interior surface 34. The actuating mechanism 78 is coupled to a wheel 80 such that the wheel 80 is actuatable between a stored position 82 wherein the wheel 80 is disengaged from both of the tether 62 and the drive roller 76 and rests nearer the interior surface 34, and a retrieval position 84 wherein the wheel 80 is moved toward the drive roller 76 to engage with the tether 62 and the drive roller 76 such that the drive roller 76 pulls the tether 62 into the tether container 42 from the tee 50 when the drive roller 76 rotates in the first direction. Electromechanical systems such as those using pneumatically driven actuators, rack-and-pinion driven actuators, belt and screw driven actuators, and other conventionally available linear actuators may be used for the actuating mechanism 78.

A control 86 is mounted on the interior surface 34. The control 86 is in communication with the driver mechanism 74 and the actuating mechanism 78. The control 86 actuates the actuating mechanism 78 to move the wheel 80 into the retrieval position 84 and actuates the driver mechanism 74 to rotate the drive roller 76 in the first direction when the control 86 receives the retrieve input. The control 86 actuates the driver mechanism 74 to stop rotating the drive roller 76 in the first direction and to actuate the actuating mechanism 78 to move the wheel 80 into the stored position 82 when the control 86 receives the seated input from the driver mechanism 74.

A button 88 is mounted to and extends upward from the base 12. The button 88 is in communication with the control 86. The button 88 is actuated to send the retrieve input to the control 86 when a user wants the ball 60 to be seated within the cup 58. The button 88 is made of a rigid material capable of withstanding repeated actuation involving the force of an adult male stepping onto the button 88.

A power supply 90 is electrically coupled to the control 86. The power supply 90 is positioned within the base 12. The power supply 90 is a battery.

In use, the ball 60 is hit off the tee 50 while in the first position 68 such that the ball 60 is in the second position 70. The tether 62 is pulled out of the tether container 42 by the ball 60 traveling away from the tee 50 until coming to a stop. The button 88 is actuated, sending the retrieve input to the control 86. The control 86 actuates the actuating mechanism 78 to move the wheel 80 to the retrieval position 84 and actuates the driver mechanism 74 to rotate said drive roller 76 in the first direction. The tether 62 is pulled into the tether container 42 until the ball 60 is seated onto the cup 58. The driver mechanism 74 senses the tension on the tether 62 and sends the seated input to the control 86. The control 86 actuates the actuating mechanism 78 to move the wheel 80 to the stored position 82 and actuates the driver mechanism 74 to cease rotation of the drive roller 76.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A motorized ball tee and tether assembly comprising:

a base including a top surface;

a housing being attached to and extending upwardly from said base, said housing having a top wall and a perimeter wall extending between said top wall and said base, said top wall having a top side and a bottom side, said perimeter wall having a top edge, a bottom edge, an interior surface and an exterior surface;

said top wall having an aperture extending therethrough from said top side to said bottom side;

a tether container being positioned within said housing;

a tee being attached to and extending upwardly from said top wall;

a ball being attached to said tether container by a tether;

a driver mechanism being mounted on said interior surface, said driver mechanism being coupled to a drive roller such that said drive roller is rotatable in a first direction by said driver mechanism; and an actuating mechanism being attached to said interior surface, said actuating mechanism being coupled to a wheel such that said wheel is actuatable between a stored position wherein said wheel is disengaged from both of said tether and said drive roller and rests nearer said interior surface, and a retrieval position wherein said wheel is moved toward said drive roller to engage with said tether and said drive roller such that said drive roller pulls said tether into said tether container from said tee when said drive roller rotates in said first direction.

2. The motorized ball tee and tether assembly according to claim 1, wherein said base includes a bottom surface and a perimeter edge extending between said top surface and said bottom surface.

3. The motorized ball tee and tether assembly according to claim 1, wherein said aperture is centrally positioned along a central axis of said top wall and said housing.

4. The motorized ball tee and tether assembly according to claim 3, wherein said aperture increases in diameter between said bottom side and half the distance between said bottom side and said top side.

5. The motorized ball tee and tether assembly according to claim 1, wherein said tether container has a top lip, an end wall and a side wall extending downwardly toward said base between said top lip and said end wall, said top lip extending outwardly from said side wall to attach to said interior surface of said housing.

6. The motorized ball tee and tether assembly according to claim 5, wherein said top lip is positioned offset from said top edge at a distance between 1.00 inch and 4.00 inches apart.

7. The motorized ball tee and tether assembly according to claim 5, wherein said side wall has a larger diameter near said top lip compared to a smaller diameter near said end wall.

8. The motorized ball tee and tether assembly according to claim 1, wherein said tee comprises:

a first section being attached to and extending upwardly from said aperture of said top wall;

a second section being telescopically coupled to and extending away from said first section, said second section having free end positioned opposite said housing, a cup being attached to and extending upwardly from said free end, said cup having an increasing diameter opposite said free end; and a locking member releasably engaging each of said first section and said second section to selectively secure said first section and said second section at a selectable position relative to each other.

9. The motorized ball tee and tether assembly according to claim 5, wherein said tether has a first end attached to said ball, and a second end attached to said end wall of said tether container, said tether having a length to allow said ball to travel between a first position wherein said ball is engaged with said cup and said tether is within said tee and said tether container, and a second position wherein said ball is traveling away from said tee and said tether is traveling out of said tether container and outside of said tee until said second end engages with said tether container to stop said ball's travel.

10. The motorized ball tee and tether assembly according to claim 1, wherein said ball has an outer shell bounding a hollow core, said ball having voids extending therethrough said outer shell to access said hollow core.

11. The motorized ball tee and tether assembly according to claim 1, wherein said drive roller is aligned with said tether when said tether passes between said tether container and said aperture of said top wall.

12. The motorized ball tee and tether assembly according to claim 1, wherein said driver mechanism sends a seated input when said driver mechanism senses a sharp increase in torque being required to rotate said drive roller due to said tether being unable to move further into said tether container.

13. The motorized ball tee and tether assembly according to claim 12, wherein a control is in communication with said driver mechanism and said actuating mechanism, said control actuating said actuating mechanism to move said wheel into said retrieval position and actuating said driver mechanism to rotate said drive roller in said first direction when said control receives the retrieve input, said control actuating said driver mechanism to stop rotating said drive roller in said first direction and to actuate said actuating mechanism to move said wheel into said stored position when said control receives said seated input from said driver mechanism.

14. The motorized ball tee and tether assembly according to claim 13, wherein said control is mounted on said interior surface.

15. The motorized ball tee and tether assembly according to claim 13, wherein a button is mounted to and extending upward from said base being in communication with said control, said button being actuated to send said retrieve input to said control when a user wants the ball to be seated within said cup.

16. The motorized ball tee and tether assembly according to claim 13, wherein a power supply is electrically coupled to said control.

17. The motorized ball tee and tether assembly according to claim 16, wherein said power supply is positioned within said base.

18. A motorized ball tee and tether assembly comprising:

a base including a top surface, a bottom surface and a perimeter edge extending between said top surface and said bottom surface;

a housing being attached to and extending upwardly from said base, said housing having a top wall and a perimeter wall extending between said top wall and said base, said top wall having a top side and a bottom side, said perimeter wall having a top edge, a bottom edge, an interior surface and an exterior surface;

said top wall having an aperture extending therethrough from said top side to said bottom side, said aperture being centrally positioned along a central axis of said top wall and said housing, said aperture increasing in diameter between said bottom side and half the distance between said bottom side and said top side;

a tether container being positioned within said housing, said tether container having a top lip, an end wall and a side wall extending downwardly toward said base between said top lip and said end wall, said top lip extending outwardly from said side wall to attach to said interior surface of said housing, said top lip being positioned offset from said top edge at a distance between 1.00 inch and 4.00 inches apart, said side wall having a larger diameter near said top lip compared to a smaller diameter near said end wall;

a tee being attached to and extending upwardly from said top wall, said tee comprising:

a first section being attached to and extending upwardly from said aperture of said top wall;

a second section being telescopically coupled to and extending away from said first section, said second section having free end positioned opposite said housing, a cup being attached to and extending upwardly from said free end, said cup having an increasing diameter opposite said free end;

a locking member releasably engaging each of said first section and said second section to selectively secure said first section and said second section at a selectable position relative to each other;

a ball being attached to said tether container by a tether, said tether having a first end attached to said ball, and a second end attached to said end wall of said tether container, said tether having a length to allow said ball to travel between a first position wherein said ball is engaged with said cup and said tether is within said tee and said tether container, and a second position wherein said ball is traveling away from said tee and said tether is traveling out of said tether container and outside of said tee until said second end engages with said tether container to stop said ball's travel, said ball having an outer shell bounding a hollow core, said ball having voids extending therethrough said outer shell to access said hollow core;

a driver mechanism being mounted on said interior surface, said driver mechanism being coupled to a drive roller such that said drive roller is rotatable in a first direction by said driver mechanism, said drive roller being aligned with said tether when said tether passes between said tether container and said aperture of said top wall, said driver mechanism sending a seated input when said driver mechanism senses a sharp increase in torque being required to rotate said drive roller due to said tether being unable to move further into said tether container;

an actuating mechanism being attached to said interior surface, said actuating mechanism being coupled to a wheel such that said wheel is actuatable between a stored position wherein said wheel is disengaged from both of said tether and said drive roller and rests nearer said interior surface, and a retrieval position wherein said wheel is moved toward said drive roller to engage with said tether and said drive roller such that said drive roller pulls said tether into said tether container from said tee when said drive roller rotates in said first direction;

a control being mounted on said interior surface, said control being in communication with said driver mechanism and said actuating mechanism, said control actuating said actuating mechanism to move said wheel into said retrieval position and actuating said driver mechanism to rotate said drive roller in said first direction when said control receives the retrieve input, said control actuating said driver mechanism to stop rotating said drive roller in said first direction and to actuate said actuating mechanism to move said wheel into said stored position when said control receives said seated input from said driver mechanism;

a button being mounted to and extending upward from said base being in communication with said control, said button being actuated to send said retrieve input to said control when a user wants the ball to be seated within said cup; and a power supply being electrically coupled to said control, said power supply being positioned within said base.

* * * * *